US006499275B1

(12) United States Patent
Graf et al.

(10) Patent No.: US 6,499,275 B1
(45) Date of Patent: Dec. 31, 2002

(54) METHOD AND SYSTEM FOR FORMING STRINGS OF POCKETED COIL SPRINGS

(75) Inventors: Roland Graf, St. Gallen (CH); Niels S. Mossbeck, Carthage, MI (US); Thomas J. Wells, Carthage, MI (US)

(73) Assignee: Spuhl AG St. Gallen, Wittenbach (CH)

( * ) Notice: Subject to any disclaimer, the term of this patent is extended or adjusted under 35 U.S.C. 154(b) by 154 days.

(21) Appl. No.: 09/595,755

(22) Filed: Jun. 16, 2000

Related U.S. Application Data

(63) Continuation-in-part of application No. 09/353,483, filed on Jul. 13, 1999, which is a continuation-in-part of application No. 09/293,221, filed on Apr. 16, 1999.

(51) Int. Cl.[7] ..... B65B 63/02

(52) U.S. Cl. ..... 53/436; 5/720; 53/438; 53/439; 53/450; 53/114

(58) Field of Search ..... 53/436, 438, 439, 53/450, 459, 114; 156/70, 291, 580.1, 580.2, 582; 5/655.8, 720

(56) References Cited

U.S. PATENT DOCUMENTS

| | | | | | |
|---|---|---|---|---|---|
| 1,218,314 | A | * | 3/1917 | Read | 53/114 |
| 1,370,533 | A | * | 3/1921 | Genge | 53/114 |
| 1,466,617 | A | | 8/1923 | Foster | |
| 1,685,566 | A | * | 9/1928 | Gail | 53/114 |
| 1,774,545 | A | * | 9/1930 | Chapman | 53/114 |
| 1,915,264 | A | | 6/1933 | Schneider et al. | |
| 1,950,186 | A | | 3/1934 | Lofman | |
| 2,093,531 | A | * | 9/1937 | Werner | 53/114 |
| 2,430,098 | A | * | 11/1947 | Binch | 53/114 |
| 2,663,475 | A | | 12/1953 | McInerney et al. | |
| 2,983,236 | A | * | 5/1961 | Thompson | 53/114 |
| 3,462,779 | A | | 8/1969 | Thompson | |
| 3,668,816 | A | | 6/1972 | Thompson | |
| 3,729,892 | A | | 5/1973 | Aslund et al. | |
| 4,111,241 | A | | 9/1978 | Crown | |

(List continued on next page.)

FOREIGN PATENT DOCUMENTS

| | | |
|---|---|---|
| WO | WO 94/18116 | 8/1994 |
| WO | WO98/11015 | 3/1998 |
| WO | WO99/35081 | 7/1999 |
| WO | WO00/78612 | 12/2000 |

OTHER PUBLICATIONS

*International Search Report*, PCT/US00/28230, Jan. 16, 2001.

Stumpf, *Method and Apparatus for the Manufacture of Pocketed Springs*, Abandoned Patent Application Serial No. 09/334,910.

Spuhl, *Automatic Pocket Spring Machine*, Mar. 30, 1996.

*Primary Examiner*—John Sipos
*Assistant Examiner*—Louis Huynh
(74) *Attorney, Agent, or Firm*—Wood, Herron & Evans, LLP

(57) ABSTRACT

A string (12) of pocketed coil springs (14) is formed by inserting compressed springs between upper and lower plies of a folded, preferably thermally weldable fabric (16). The springs are maintained in a compressed configuration while a longitudinal seam (54) joins the free edges of the thermally welded fabric (16) together. Subsequently, the compressed springs (14) are allowed to relax into an expanded configuration after which a transverse seam (80) is formed in the fabric (16) between the adjacent springs (14) thereby encapsulating each spring (14) within a fabric pocket (86). The string (12) of pocketed coil springs (14) is advantageously formed without the need for reorienting the springs (14) after being inserted between the plies (24, 26) of the fabric (16) and thereby avoiding the disadvantages and complications associated with turning or reorienting the pocketed coil spring (14).

27 Claims, 5 Drawing Sheets

U.S. PATENT DOCUMENTS

| | | | | | |
|---|---|---|---|---|---|
| 4,234,983 | A | | 11/1980 | Stumpf | |
| 4,439,977 | A | | 4/1984 | Stumpf | |
| 4,451,946 | A | | 6/1984 | Stumpf | |
| 4,485,506 | A | | 12/1984 | Stumpf et al. | |
| 4,565,046 | A | | 1/1986 | Stumpf | |
| 4,578,834 | A | | 4/1986 | Stumpf | |
| 4,713,956 | A | | 12/1987 | Sasaki et al. | |
| 4,854,023 | A | | 8/1989 | Stumpf | |
| 4,986,518 | A | | 1/1991 | Stumpf | |
| 5,059,277 | A | * | 10/1991 | Willhite et al. | 156/580.1 |
| 5,126,004 | A | | 6/1992 | Suenens et al. | |
| 5,553,443 | A | | 9/1996 | St. Clair et al. | |
| 5,572,853 | A | | 11/1996 | St. Clair et al. | |
| 5,613,287 | A | | 3/1997 | St. Clair | |
| 5,740,597 | A | | 4/1998 | Eto | |
| 5,749,133 | A | | 5/1998 | Mauldin et al. | |
| 6,021,627 | A | * | 2/2000 | Mossbeck et al. | 53/438 |
| 6,101,697 | A | | 8/2000 | Stumpf et al. | |
| 6,120,629 | A | * | 9/2000 | Shannon et al. | 156/580.2 |
| 6,122,900 | A | | 9/2000 | Mossbeck et al. | |
| 6,131,892 | A | | 10/2000 | Stumpf | |
| 6,260,331 | B1 | | 7/2001 | Stumpf | 53/436 |

* cited by examiner

METHOD AND SYSTEM FOR FORMING STRINGS OF POCKETED COIL SPRINGS

This is a continuation-in-part of U.S. patent application Ser. No. 09/353,483, filed Jul. 13, 1999, which in turn was a continuation in part of U.S. patent application Ser. No. 09/293,221, filed Apr. 16, 1999, each of which are hereby incorporated by reference in their entirety.

BACKGROUND OF THE INVENTION

This invention relates generally to spring assemblies for mattresses, cushions and the like, and, more particularly, to a method and system for making a string of connected individually pocketed coil springs for mattresses, cushions, spring units and the like.

Pocketed coil springs are often referred to as a Marshall construction in which each coil spring is encased within its own fabric sack or pocket. The sack or pocket is typically defined between two plies of a fabric strip connected together at intervals along transverse lines spaced along the strip. The two-ply fabric strip is generally formed by folding a strip of double width fabric upon itself along a longitudinal centerline, leaving the overlapped plies along the unjoined opposite edges of the strip to be connected to each other along a longitudinal seam to close the pockets defined between the transverse lines of connection after the springs are inserted between the plies.

A variety of techniques have evolved for the manufacture of pocketed springs, some contemplating the creation of the pockets within the fabric plies prior to insertion of the wire spring and others contemplating the insertion of compressed wire springs between the plies of the strip and the subsequent creation of the pockets by stitching or otherwise joining the two plies to each other along transverse lines between adjacent springs. Irrespective of the technique used, the fabric is closed around the spring after the insertion of the spring, usually by stitching or welding the two plies together along a line parallel to the free edges of the plies. Joining the plies together by stitching has largely been replaced in more recent times by the use of a heat sensitive fabric and ultrasonic welding techniques. Examples of known systems and techniques for manufacturing strings of pocketed coil spring are disclosed in U.S. Pat. Nos. 4,439,977; 4,234,983; and 5,613,287, each of which are incorporated herein by reference.

Specifically, in U.S. Pat. No. 4,439,977, a method and apparatus are disclosed for making coil springs enclosed within individual pockets in an elongate fabric strip comprised of two overlying plies capable of being thermally welded together. The fabric strip is fed along a guide path during which compressed springs are inserted between the plies with the axes of the springs substantially normal or perpendicular to the planes of the plies. Thereafter, the fabric plies are thermally welded together longitudinally and transversely while the spring remains compressed to form a string of pocketed coils. After thermal welding, the pocketed coils are passed through a turner assembly during which the springs are reoriented typically about 90° within the fabric pockets to positions wherein the axes of the springs are transverse to the fabric strip.

One specific disadvantage of this method of manufacturing pocketed coil springs is that during the turning process, springs tend to become entangled or hooked together and do not achieve their proper positions. As such, additional and costly labor is required to reorient and disentangle the springs to place them into their desired configurations and orientations. Even if the springs do not become entangled or hooked, difficulties may still arise in correctly aligning them to their desired positions with the longitudinal axes of the springs being substantially parallel to one another and the transverse seams defining individual pockets.

Another common problem with this type of operation is that during the turning of the pocketed springs, whether or not the springs become hooked or entangled and the turning process is successful, the fabric surrounding the spring is often damaged, torn, punctured or the like. In one form, the springs are beaten by paddles as disclosed in U.S. Pat. No. 4,439,977 to effect the turning of the spring within the pocket. Obviously, the repeated beating on the pocket with the paddles may cause significant damage to the fabric material and prove to be unreliable to accurately position the spring within the fabric pocket. When this happens, the damaged pocket should be repaired or removed from the string thereby interrupting the process and requiring significant operator intervention and down time for the production of pocketed coil springs.

Therefore, a need exists for a method and system for forming strings of pocketed coil springs which overcomes the above described disadvantages of the prior art and does not require the turning of the springs within the pockets for alignment of the spring axes in a generally parallel and ordered arrangement nor operator intervention to unhook or disentangle the springs nor repair the damaged fabric surrounding the springs. Further, a need has always existed to provide commercially viable methods and systems for producing strings of pocketed coil springs which are cost and labor effective by requiring a minimal amount of labor intervention and associated resources.

SUMMARY OF THE INVENTION

The present invention overcomes the above described and other disadvantages in the prior art by providing an improved method and system for producing strings of pocketed coil springs which are effective in performance, yet cost effective in that they require a minimum amount of materials and labor. The manner in which the springs are inserted into the fabric and the formation of the pocket according to this invention avoid the need for turning or repositioning the springs within the pockets while still providing an efficient and reliable manufacturing system and associated method for reliably producing consistently aligned springs within undamaged fabric pockets.

The present invention preferably begins with the insertion of a compressed coil spring between upper and lower plies of a folded thermally welded fabric. The present invention is a continuous production process such that the fabric is indexed or pulled past a spring insertion station so that the compressed springs are individually inserted between the plies of the folded fabric at spaced intervals as the fabric passes the spring insertion station. The springs are maintained in a compressed configuration between the plies of the fabric while a longitudinal seam is formed in the fabric to join the two plies together proximate free edges of the plies opposite from a longitudinal fold line of the fabric. Since the fabric is a thermally weldable material, preferably the longitudinal seam is formed by a cooperating thermal weld head and anvil combination. After the spring has advanced past the longitudinal weld station, it is allowed to relax and expand within the fabric into an upright position in which a longitudinal axis of the spring is generally perpendicular to the longitudinal seam of the fabric. Preferably, the relaxation and expansion of the springs within the fabric are controlled by a pair of rotating members on opposite sides of the springs according to various alternative embodiments of this invention. The rotating members in presently preferred embodiments may be a pair of oppositely rotating wheels with axes of rotation generally parallel to the longitudinal axes of the springs. The wheels include a plurality of arcuate-shaped recesses which combine to partially surround each spring during the expansion. Alternatively, the rotating members may include a pair of bands each passing over a pair of spaced rollers. The fabric and springs pass between the bands and a separation distance between the bands increases in a downstream direction to thereby control the expansion of the springs between the bands. In either embodiment, the springs are supported during their expansion into an upright position.

After the springs have expanded within the fabric, individual pockets are formed preferably by a transverse weld head sealing the fabric between each of the springs generally parallel to the spring axes. The transverse seams are formed in the fabric to complete the individual pockets for the individual springs. Finally, a pair of opposing and rotating transport wheels indexes or moves the string of pocketed springs forwardly thereby advancing the fabric and enclosed springs through the various stations as described.

Advantageously, the orientation of the springs remains generally unchanged throughout the pocketing process so that reorientation, turning or the like of the springs within the pockets is avoided. Moreover, the longitudinal seam formed in the fabric is positioned on a side face of the individual spring pockets in the resulting string of pocketed coil springs thereby avoiding the problem known in the art as "false loft". False loft occurs when the longitudinally extending seams maintain the cover material at a certain distance away from the ends of the springs so that when the mattress is first purchased, this distance is fairly uniform. However, after the mattress or cushion has been in use for a period of time, the longitudinally extending seams or other excess fabric in the pocketed coil string may become crushed thus leaving areas or regions of depression. With continued use of the mattress or cushion, the entire support surface of the mattress or cushion will similarly be crushed and will appear substantially flat. A user may not realize the source of this phenomenon and consider it to be a defect in the mattress or cushion.

The problem of false loft is thereby avoided in the present invention by positioning the longitudinal seam of the string of springs on a side thereof while still avoiding the need to turn or reorient the individual springs within the pockets and the resulting damage to the fabric and other associated problems.

Another feature of this invention which also aids in the reduction of false loft and related problems is particularly useful for barrel shaped springs or other such springs which have a non-linear profile. With such springs, the transverse seam between adjacent springs in the string is shaped to conform to the profile of the springs and thereby produce a tighter, more conforming fabric pocket around the spring to avoid bunching or excess loose fabric around the spring.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
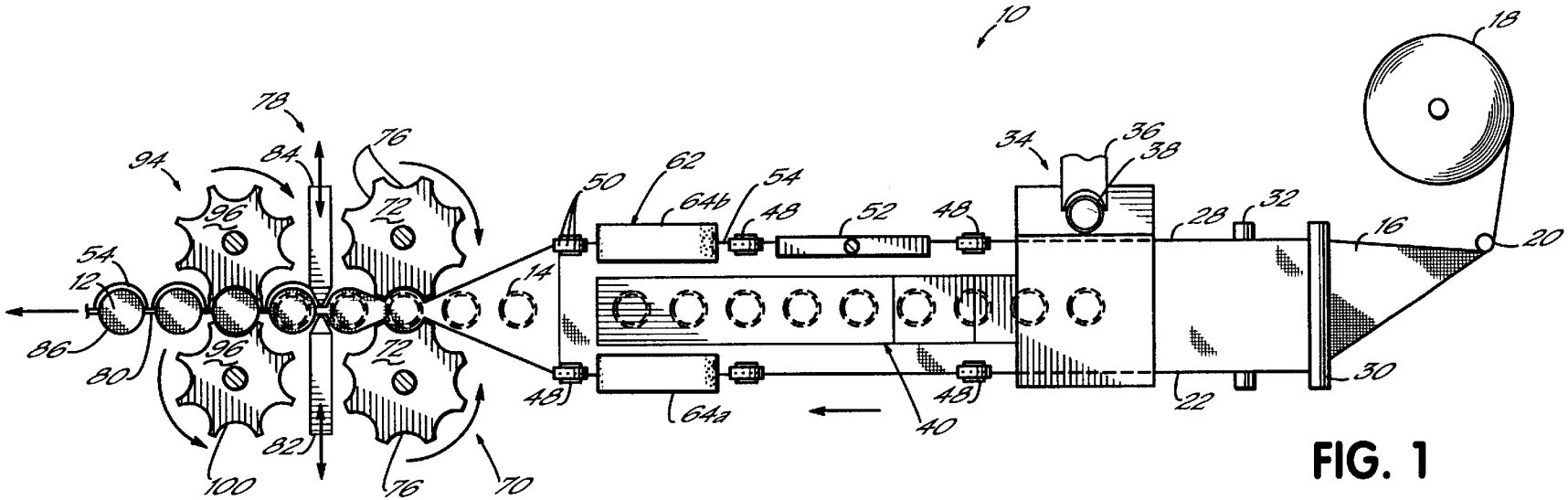
FIG. 1 is a top plan view of a schematic representation of a system and associated method according to a first embodiment for producing a string of pocketed coil springs of this invention.

Referring to FIG. 1, a first presently preferred embodiment of a system 10 and associated method for forming a string 12 of pocketed coil springs 14 according to this invention is shown. Fabric 16, preferably thermally weldable as is well known in the art, is fed from a supply roll 18 around a roller 20 as shown in FIG. 1. Alternatively, the fabric 16 could be cotton or another suitable material. The fabric 16 is folded generally in half longitudinally about a longitudinal fold line 22 which coincides approximately with a longitudinal centerline of the fabric 16. The fabric 16 is folded about the longitudinal fold line 22 to produce a first, upper ply 24 and a second, lower ply 26 of fabric 16 each with a free edge 28 spaced from the longitudinal fold line 22. The folded fabric 16 passes upper and lower input rollers 30, 32 prior to entering a spring insertion station 34. The rollers 20, 30 and/or 32 may be rotationally driven.

The spring insertion station 34 includes a reciprocating insertion plunger 36 having a cup-shaped spring receiving leading end 38 to receive therein a compressed coil spring 14. The plunger 36 extends to insert the compressed spring 14 between the plies 24, 26 and retracts to receive another compressed spring 14 for subsequent insertion. The spring 14 is formed and compressed and loaded onto the spring insertion plunger 36 and the fabric 16 is folded according to one of any number of well known systems and methods for doing so. Alternatively, the spring insertion station 34 may comprise two U-shaped profiles which keep the spring 14 compressed and lead the springs 14 inside the folded fabric 16. In this method, the spring 14 is held with a horn (not shown) while the profiles return.

Figure 2:
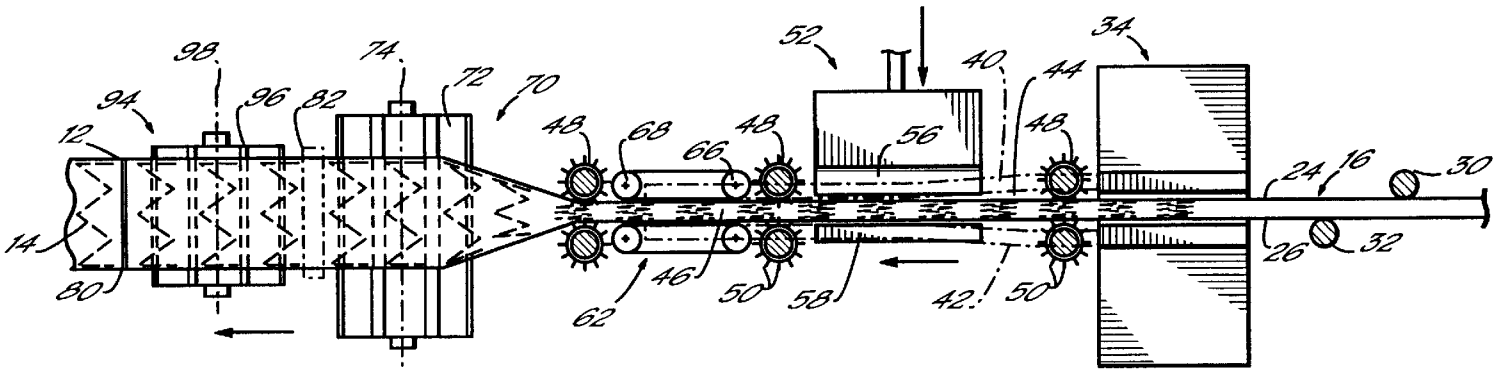
FIG. 2 is a side elevational view of the system and method of FIG. 1.

As the fabric 16 advances through the system 10, the springs 14 inserted between the plies 24, 26 are maintained in a compressed configuration between upper and lower support plates 40, 42 on the upper and lower faces, respectively, of the fabric 16 as particularly shown in FIGS. 1 and 2. Preferably, the support plates 40, 42 are centered between the free edges 28 and longitudinal fold line 22 of the fabric 16 and may include a wider region 44 proximate the spring insertion station 34 which tapers downwardly to a region of smaller separation 46 between the plates 40, 42 as the fabric 16 and springs 14 advance through subsequent portions of the system 10.

Additionally, a plurality of spaced alignment wheels 48 which are mounted for rotation proximate the longitudinal fold line 22 and free edges 28 of the fabric 16 control and direct the movement of the fabric 16 through the system 10. The alignment wheels preferably include a plurality of projections 50 which engage the fabric 16 to maintain the movement of the fabric 16 in an aligned orientation with respect to the various stations and components of the system 10.

A longitudinal seam forming station 52 is located downstream from the spring insertion station 34 proximate the free edges 28 of the fabric 16, as shown in FIGS. 1 and 2. After the compressed springs 14 are inserted between the plies 24, 26, the longitudinal seam forming station 52 joins the upper and lower plies 24, 26 of the fabric 16 together proximate their respective free edges 28 thereby initially enclosing the springs 14 within the fabric 16. In a presently preferred embodiment, a longitudinal seam 54 is formed between a thermal weld head 56 which reciprocates downwardly and upwardly for cooperating welding engagement and disengagement, respectively, relative to an anvil 58 positioned below the lower ply 26. The reciprocating weld head 56 and anvil 58 cooperate to form the longitudinal seam 54 in the fabric 16 by welding the respective plies 24, 26 together ultrasonically, thermally, or the like as is well known by those skilled in the art. Alternatively, the anvil 58 is moved reciprocally while the thermal weld head 56 remains stationary. The springs 14 remain compressed during the formation of the longitudinal seam 54 and weld with their longitudinal axes 60 generally perpendicular to the longitudinal seam 54. It should be appreciated that other means for joining the plies 24, 26 together to form the seams such as stitching, staples, or other means are well within the scope of the present invention.

A first transport station 62 is located downstream from the longitudinal seam forming station 52 and, in a presently preferred embodiment, includes four transport bands 64. Each band 64 passes over spaced forward and trailing rollers 66, 68, at least one of which is rotationally driven. A first pair of bands 64*a* at the first transport station 62 contacts the fabric 16 proximate the longitudinal fold line 22 passing therebetween. Another pair 64*b* of transport bands 64 contacts the fabric 16 proximate the longitudinal seam 54 as shown in FIGS. 1 and 2. As the bands 64 pass around the spaced rollers 66, 68 in contact with the fabric 16, the fabric 16 is pulled from the supply roll 18 through the upstream stations and is advanced toward a downstream spring expansion station 70.

The compressed springs 14 are permitted to relax and expand within the fabric 16 at the spring expansion station 70. In a first embodiment, the expansion of the springs 14 is controlled by a pair of oppositely rotating rotational members 72 on opposite sides of the springs 14 as shown in FIG. 1. An axis of rotation 74 of each of the rotational members 72 according to the first presently preferred embodiment of FIG. 1 is generally parallel to the longitudinal axes 60 of the springs 14. Each rotational member 72 includes a plurality of arcuate-shaped recesses 76, each of which combine with a similarly configured recess 76 in the corresponding rotation member 72 on the opposite side of the spring 14 to partially surround each spring 14 and thereby control the expansion thereof. Additionally, the rotational members 72 assist in advancing the springs 14 and fabric 16 toward a transverse seam forming station 78 located downstream therefrom.

The transverse seam forming station 78 forms a transverse seam 80 in the fabric 16 between each of the adjacent springs 14 which have expanded within the fabric 16 from their compressed configuration. Preferably, the transverse seam forming station 78 includes a transverse seam weld head 82 and a cooperating transverse seam anvil 84 located on opposite sides of the forming string 12 of pocketed coil springs 14 from each other, as shown in FIG. 1. As the springs 14 advance toward and through the transverse seam forming station 78, the fabric 16 between the springs 14 is joined together thereby completing individual pockets 86 for each of the springs 14 and enclosing the springs 14 within the fabric 16. Once again, it should be readily appreciated that other means for forming the transverse seam 80 such as stitching, staples or the like may be used within the scope of this invention. While the transverse seam 80 is formed, the fabric 16 is needed or gathered. As such, the string 12 of pocketed coil springs 14 must give in or contract somewhat to accommodate the seam forming process. This can be accomplished with an active mechanism such as a driven transport system or with in a passive manner such as friction between the fabric 16 and the transport rotational members 72.

The longitudinal axes 60 of the springs 14 remain generally parallel to the transverse seams 80 in the fabric 16. However, due to the expansion of the springs 14, the longitudinal seam 54 formed at the free edges 28 of the fabric 16 is positioned generally on a side face 88 of the string 12 of pocketed coil springs 14 between top and bottom ends 90, 92 of the pocketed coil spring 14 as shown particularly in FIGS. 5 and 6. With the longitudinal axes 60 of the springs 14 generally aligned and parallel with one another within individual fabric pockets 86, the present invention avoids the need for turning the springs 14 within the fabric pockets 86 as is required in many prior art systems.

Figure 5:
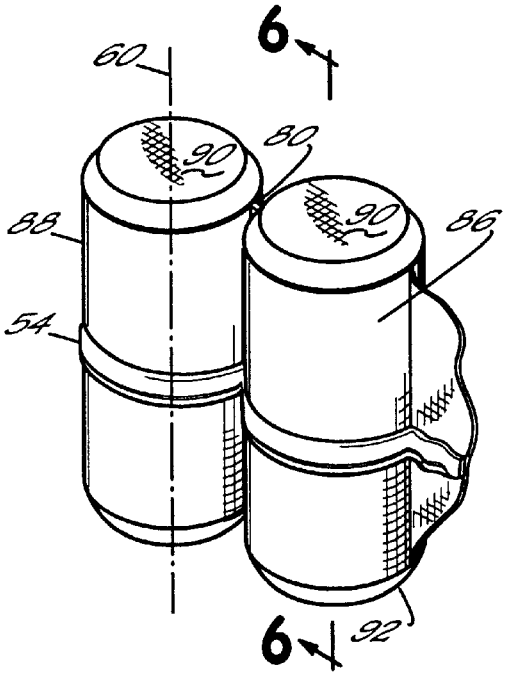
FIG. 5 is a perspective view of a string of pocketed coil springs produced according to this invention.
Figure 6:
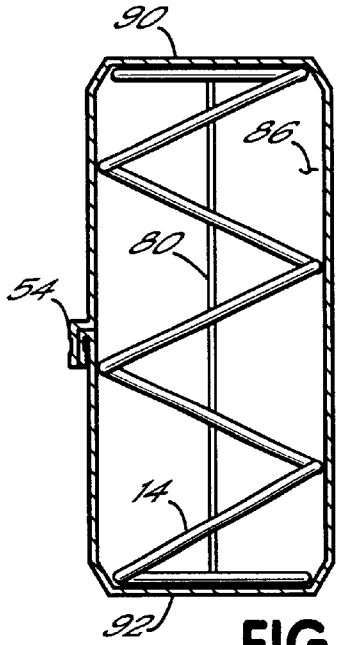
FIG. 6 is a cross-sectional view of an individual coil spring encased within a fabric pocket as taken along line 6—6 of FIG. 5.

Referring to FIGS. 5 and 6, the longitudinal seam 54 preferably becomes attached to the pockets 86 when the transverse seam 80 is formed by the transverse seam forming station 78. As such, in the region of the fabric 16 proximate the transverse seam 80, four layers of fabric 16 are welded together at the transverse seam forming station 78. It should be appreciated that there are other methods to fix the seam 80 in this manner, for example, the longitudinal seam 54 could be positioned and tacked or fixed to the side 88 of the pockets 86 prior to entering the transverse seam forming station 78 even if it is not welded to the pockets 86 with the transverse seam 80. Further, the longitudinal seam 54 may be located anywhere between the top and bottom of the string although it is shown in the drawings as approximately in the middle thereof.

A downstream or second transport station 94 preferably includes a pair of oppositely rotating transport wheels 96 each with an axis 98 of rotation generally parallel to the longitudinal axes 60 of the springs 14. A plurality of arcuate recesses 100 on the periphery of the transport wheels 96 cooperate to at least partially surround the pocketed springs 14 and advance them from the upstream transverse seam forming station 78 for discharge and subsequent packaging, storage or processing into a mattress, cushion or innerspring unit.

Figure 3:
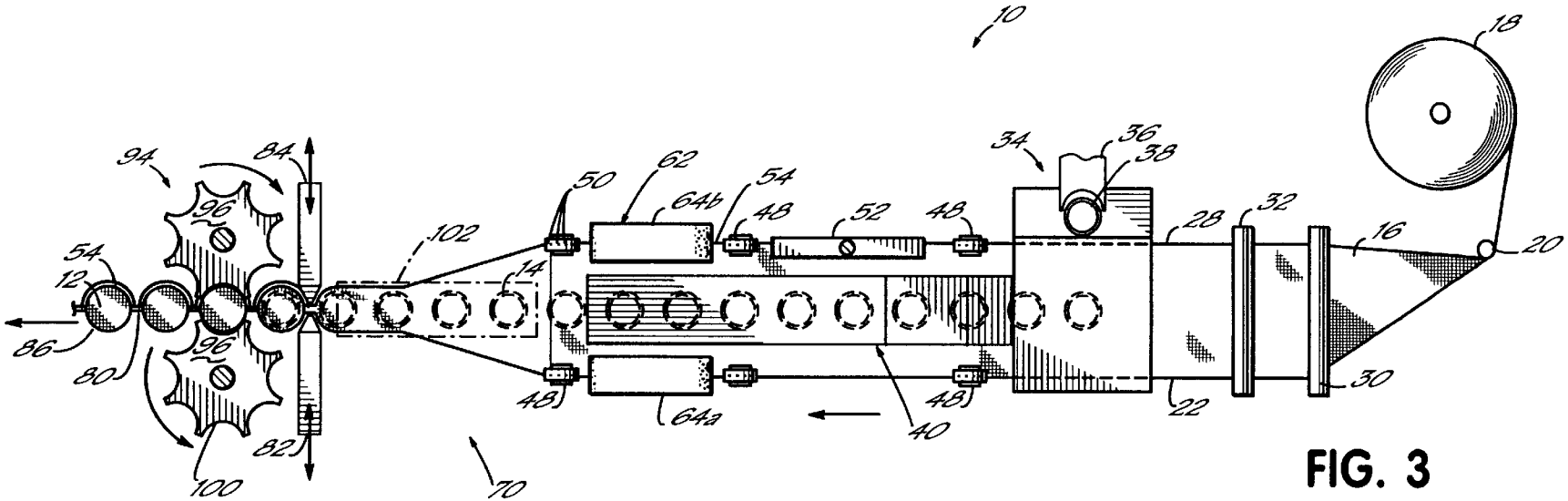
FIG. 3 is a view similar to FIG. 1 of a second presently preferred system and associated method according to this invention.
Figure 4:
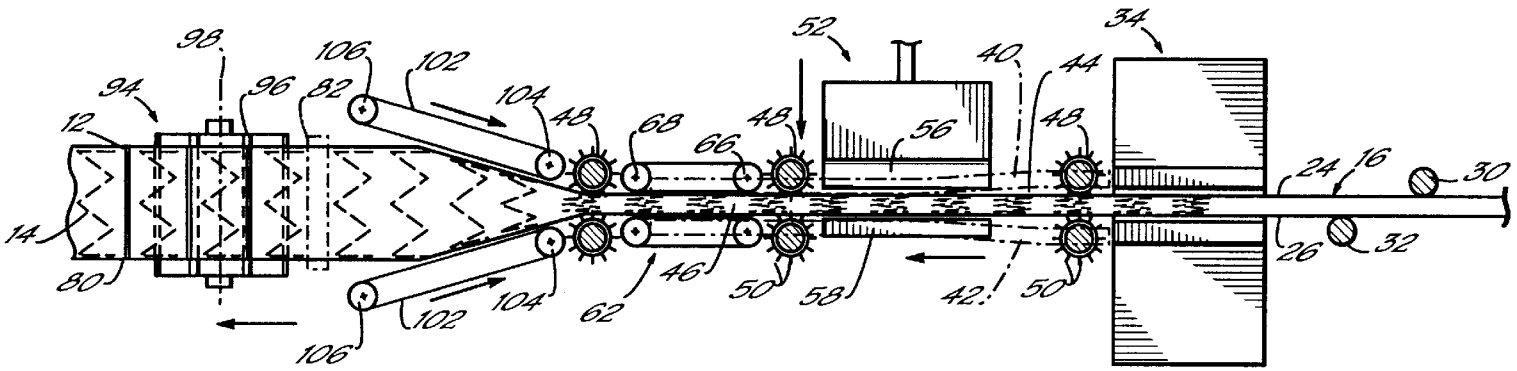
FIG. 4 is a side elevational view of the system and method of FIG. 3.

An alternative embodiment of this invention is shown in FIGS. 3 and 4 and components of the system 10 of FIGS. 3 and 4 which are similar to those of the first embodiment shown in FIGS. 1 and 2, are identified by identical reference numerals and the previous detailed description with respect to those items provided hereinabove is likewise applicable to the embodiment of FIGS. 3 and 4. The second presently preferred embodiment shown in FIGS. 3 and 4 includes divergent transport bands 102 located above and below the fabric 16 and enclosed springs 14 at the spring expansion station 70. The transport mechanism could be embodied with wheels as in FIGS. 1 and 2 and/or transport bands as in FIGS. 3 and 4 which are located on the top and bottom of the string or the lateral side surfaces as desired. Each of the transport bands 102 of FIGS. 3 and 4 pass over forward and trailing rollers 104, 106, as shown particularly in FIG. 4. Furthermore, a separation distance between the transport bands 102 increases in a downstream direction thereby permitting the controlled expansion of the springs 14 positioned in the fabric 16 between the transport bands 102. The relaxed and expanded springs 14 are then advanced to the downstream transverse seam forming station 78 so that the transverse seam 80 may be positioned between the adjacent springs 14 to complete the individual fabric pockets 86.

Figure 7:
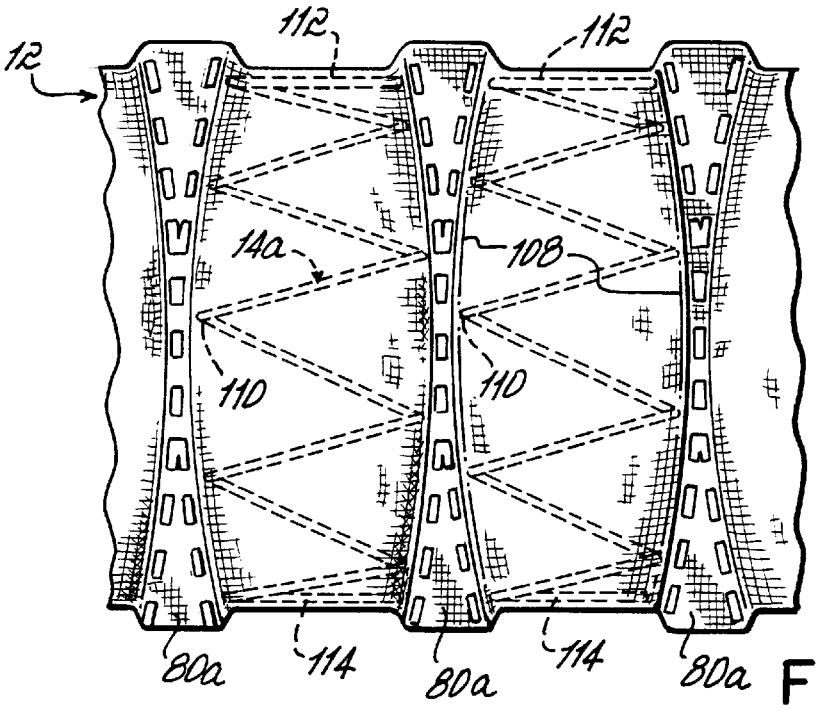
FIG. 7 is a side elevational view of a string of pocketed coil springs produced according to an alternative embodiment of this invention.
Figure 8:
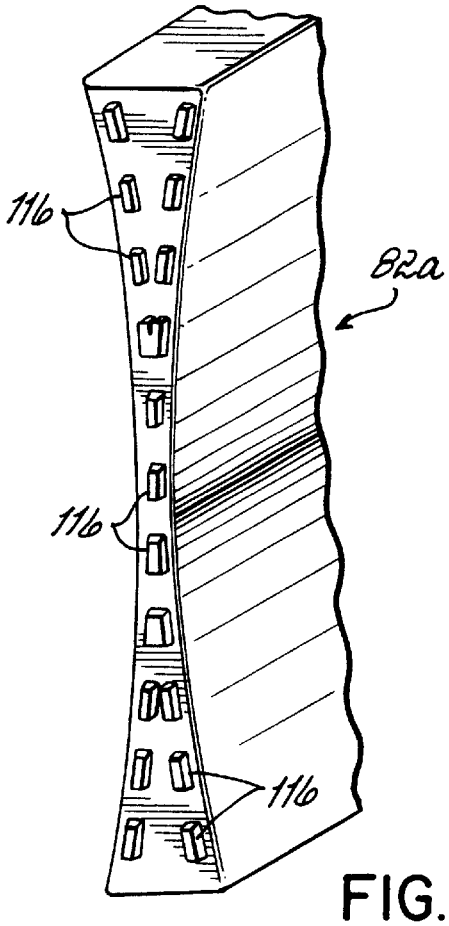
FIG. 8 is a partial perspective view of a weld head used to weld a transverse seam in the string of FIG. 7.

An additional feature of this invention is shown in FIGS. 7 and 8 and is particularly adapted for use in constructing strings 12 of pocketed coil springs 14*a* having a barrel shaped configuration as shown in FIG. 7. Barrel shaped springs 14*a* are well known in the industry and include a profile 108 in which the middle turns 110 of the spring 14*a* have a greater diameter than the top turn 112 and bottom turn 114 of the spring 14*a*. For example, the top and bottom turns 112, 114 of the barrel shaped spring 14*a* may have a diameter of about 1.625 inches and the middle turn 110 have a diameter of about 2.5 inches. When barrel shaped springs 14*a* are used in the string 12, the transverse seam 80*a* adjacent to the spring 14*a* conforms to the profile 108 of the spring 14*a* as shown in FIG. 7. With the transverse seam 80*a* conforming to the profile 108 of the spring 14*a* encased in the pocket a tighter pocket is produced with less loose fabric 16 in the string 12 and a better overall product, especially with springs 14*a* having a non-linear profile. With barrel shaped springs 14*a,* the transverse seam 80*a* adjacent thereto has a concave shape and because the transverse seam 80*a* is located between adjacent barrel shaped springs 14*a* the seam 80*a* may have a pair of outwardly facing concave shapes forming an X or similar configuration.

A weld head 82*a* suitable for forming the transverse seam 80*a* is shown in FIG. 8 in which a number of studs 116 are arranged in the pattern shown so that adjacent studs 116 proximate the top and bottom of the weld head 82*a* are spaced farther apart than those in the middle to conform with the profiles 108 of the adjacent barrel shaped springs 14*a*. Although the transverse seam 80*a* of FIG. 7 is symmetric, other configurations are contemplated within the scope of this invention. Moreover, in another sense, this feature of the invention is useful not only for barrel shaped springs 14*a* to form a tighter, more conforming fabric pocket, but also for springs having a non-linear profile in general such as the barrel shaped springs and hour glass shaped springs in which the middle turns have a lesser diameter than the top and bottom turns.

Figure 9:
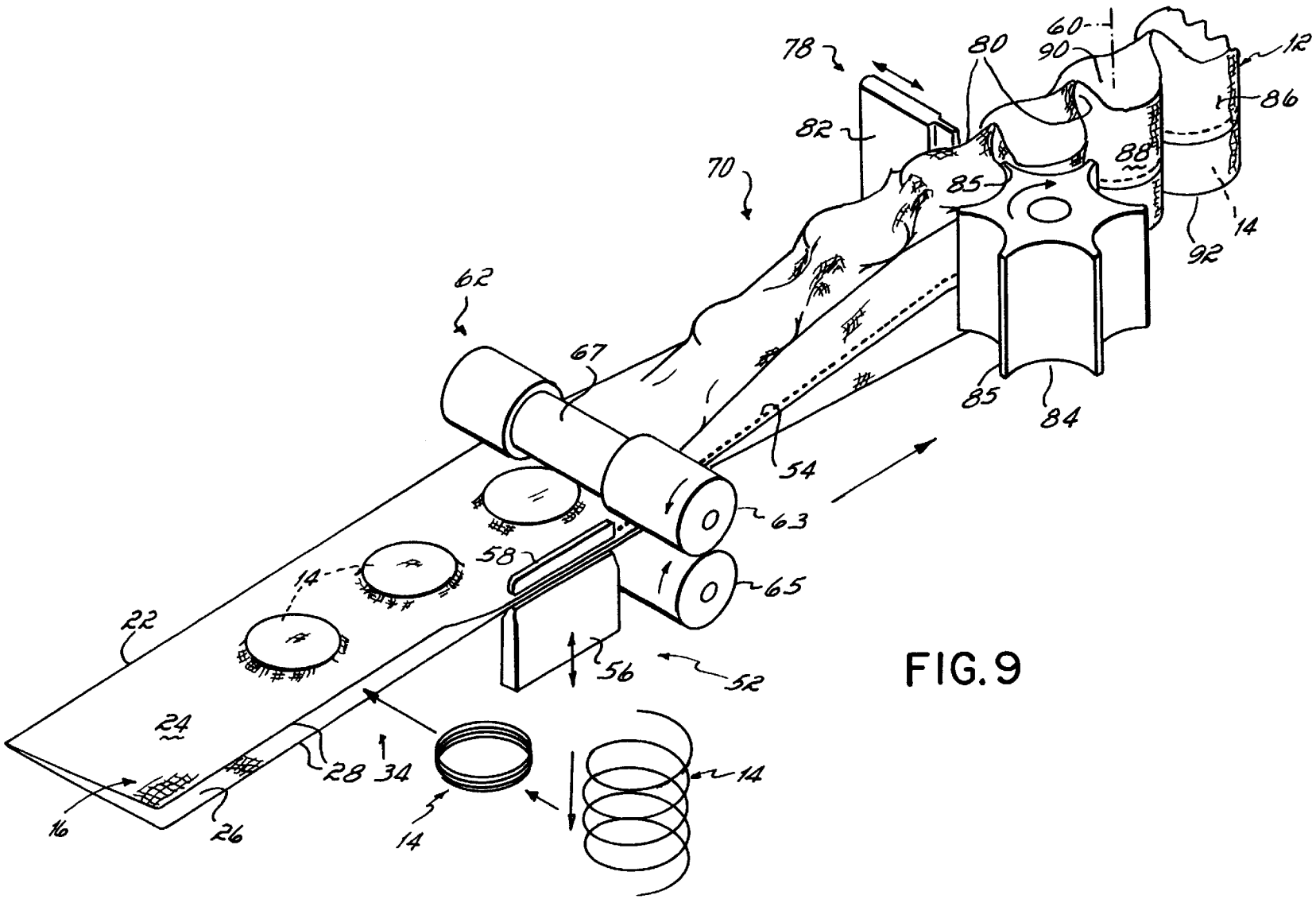
FIG. 9 is a perspective view of a third presently preferred system and associated method according to this invention.

An additional alternative embodiment of this invention is shown in FIG. 9 and components of the system 10 which are similar similar to those of the other embodiments are identified by identical reference numerals. The embodiment shown in FIG. 9 includes the preferably thermally weldable fabric 16 which is folded generally in half longitudinally about the longitudinal fold line 22 which coincides approximately with a longitudinal centerline of the fabric 16. The fabric 16 is folded about the longitudinal fold line 22 to produce a first, upper ply 24 and a second, lower ply 26 of fabric 16 each joined to one another at the longitudinal fold line 22 and having a free edge 28 spaced from the longitudinal fold line 22. The folded fabric 16 enters the spring insertion station 34 at which the compressed spring 14 is inserted between the plies 24, 26 of the fabric 16 as previously described with respect to the other embodiments of this invention.

As the fabric 16 initially advances through the system 10, the springs 14 inserted between the plies 24, 26 are maintained in a compressed configuration, as for example between upper and lower support plates which have been omitted from FIG. 9 for clarity.

The fabric 16 advances to the longitudinal seam forming station 52 which is located downstream from the spring insertion station 34 and is proximate the free edges 28 of the fabric 16. The longitudinal seam forming station 52 joins the upper and lower plies 24, 26 of the fabric 16 together proximate their respective free edges 28 to thereby initially enclose the springs 14 within the fabric 16. The longitudinal seam 54 is formed between the thermal weld head 56 which reciprocates downwardly and upwardly for cooperating welding engagement and disengagement, respectively, with the anvil 58. The reciprocating weld head 56 and anvil 58 cooperate to form the longitudinal seam 54 in fabric 16 by welding the respective plies 24, 26 together. It should be appreciated that other means for joining the plies 24, 26 together to form the longitudinal seam 54 such as by stitching, staples or other means, are well within the scope of this invention.

The first transport station 62 is located downstream from the longitudinal seam forming station 52 and includes cooperating upper and lower material feed rollers 63, 65, respectively. The rollers 63, 65 rotate in opposite directions, as shown in FIG. 9, to thereby advance and feed the fabric 16 through the various stations of the system 10. Advantageously, a center region 67 of each roller 63, 65 has a reduced diameter with respect to the remainder of the roller 63, 65 to allow the compressed spring 14 to pass between the rollers 63, 65 while still maintaining secure contact and engagement between the fabric 16 and the remainder of the feed rollers 63, 65. As the fabric 16 passes between the rollers 63, 65, it is pulled from the supply roll (not shown in FIG. 9) through the upstream stations and is advanced toward a spring expansion region 70.

The compressed springs 14 are permitted to relax and expand within the fabric 16 in the spring expansion region 70. The expansion of the springs 14 in the spring expansion region 70 may be uncontrolled or controlled by various mechanisms as previously described herein.

The transverse seam forming station 78 forms the transverse seam 80 in the fabric 16 between each of the adjacent springs 14 which have expanded within the fabric 16 from their initially compressed configuration. Preferably, the transverse seam forming station 78 includes first and second transverse seam forming members which in one embodiment includes the transverse seam weld head 82 which reciprocates toward and away from the fabric 16. The transverse seam weld head 82 cooperates with a transverse seam anvil 84 located on an opposite side of the forming string 12 of pocketed coil springs 14, as shown in FIG. 9. According to the embodiment shown in FIG. 9, the anvil 84 is a rotating wheel with an axis of rotation generally parallel to the longitudinal axes 60 of the springs 14. A plurality of arcuate recesses 87, six of which are shown in FIG. 9, are on the periphery of the anvil wheel 84 to at least partially surround the pocketed springs 14 as they advance through the transverse seam forming station 78. An anvil face 85 is formed between each adjacent pair of arcuate recesses 87. Each anvil face 85 cooperates with the transverse weld head 82 to form the transverse seam 80 between the adjacent springs 14. The rotation of the anvil 84 is synchronized with the reciprocal movement of the weld head 82 so that each time the weld head 82 advances toward the forming string 12, it cooperates with the rotating anvil 84 to successively form the transverse seams 80 in cooperation with the successive anvil faces 85. The anvil 84 of FIG. 9 may be rotationally driven to assist in the movement of the string 12 and springs 14 through the system 10.

As a result of the system and method of FIG. 9, the string 12 of pocketed coil springs 14 is formed with the longitudinal axes 60 of each of the springs 14 remaining generally parallel to the transverse seams 80 in the fabric 16. Due to the expansion of the springs 14, the longitudinal seam 54 formed at the free edges 28 of the fabric 16 is positioned generally on the side face 88 of the string 12 between the top and bottom ends 90, 92 of the pocketed coil springs 14. As such, the present invention avoids the need for turning the springs 14 within the fabric pocket as is required in the prior art systems. Moreover, the longitudinal seam 54 preferably becomes attached to the side face 88 when the transverse seam 80 is formed at the transverse seam forming station 78. Therefore, in the region of the fabric 16 proximate the transverse seam 80, typically four layers of fabric 16 are seeded together at the transverse seam forming station 78.

Additionally, the system of FIG. 9 may include the transverse seam configuration 80*a*, as shown in FIG. 7, or similar arrangement for contouring the transverse seam 80, 80*a* to the shape of barrel-shaped springs 14*a* or other spring configurations as is discussed with reference to FIGS. 7 and 8. The configuration of the transverse seam 80, 80*a* may be accomplished by appropriately configuring the weld head 82, anvil 84 or the anvil faces 85 of FIG. 9.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A method of forming a string of pocketed coil springs comprising the steps of:

feeding a supply of fabric having first and second generally parallel plies;

inserting a series of compressed springs between the first and second plies;

joining the first and second plies together to form a longitudinal seam proximate free edges of the first and second plies;

allowing the springs to at least partially expand to an extent permitted by the fabric so that a longitudinal axis of each of the springs is generally perpendicular to the longitudinal seam of the fabric; and forming a transverse seam in the fabric generally parallel to the longitudinal axis of the springs and between adjacent springs to thereby enclose each of the springs within a fabric pocket;

wherein the transverse seam is formed after the springs are allowed to at least partially expand.

2. The method of claim 1 wherein the springs are allowed to at least partially expand prior to forming the transverse seam and after joining the first and second plies to form the longitudinal seam.

3. The method of claim 1 wherein the joining and forming steps are performed by welding the fabric together.

4. The method of claim 1 wherein the longitudinal seam is positioned generally on the side of the springs between top and bottom ends thereof and tacked to the side of the pocket in the formed string of pocketed coil springs.

5. The method of claim 1 wherein the springs are compressed while the first and second plies are joined to form the longitudinal seam and the springs are more relaxed to the fullest extent permitted by the fabric while the transverse seam is formed.

6. The method of claim 1 wherein the orientation of the longitudinal axes of the springs remains generally unaltered during the entire process.

7. The method of claim 1 wherein the inserting further comprises inserting compressed springs which have a generally non-linear shaped profile and the forming of the transverse seam further comprises forming the transverse seam to generally correspond to at least a portion of the profile of the adjacent springs.

8. The method of claim 7 wherein the springs being inserted are barrel shaped.

9. The method of claim 1 wherein the inserting further comprises inserting compressed barrel shaped springs and the forming of the transverse seam further comprises forming the transverse seam to have a generally concave configuration adjacent to the barrel shaped springs.

10. The method of claim 1 wherein the recited steps are performed sequentially in the order recited in claim 1.

11. The method of claim 1 wherein the forming of the transverse seam includes a first and a second transverse seam forming member which are located on opposite sides of the fabric and cooperate to form the transverse seam, the forming further comprising:

rotating the first transverse seam forming member.

12. The method of claim 11 further comprising:

reciprocating the second transverse seam forming member toward and away from the first transverse seam forming member; and synchronizing t he rotating and reciprocating of the first and second transverse seam forming members, respectively, for forming the transverse seam.

13. The method of claim 12 further comprising:

at least partially surrounding each spring with one of a plurality of arcuate recesses formed on the first transverse seam forming member.

14. The method of claim 11 wherein the inserting further comprises inserting compressed springs which have a generally non-linear shaped profile and the forming of the transverse seam further comprises forming the transverse seam to generally correspond to at least a portion of the profile of the adjacent springs.

15. The method of claim 1 wherein the joining of the first and second plies to form the longitudinal seam results in the free edges of the first and second plies being located on an opposite side of the longitudinal seam from the springs.

16. The method of claim 1 further comprising:

folding the fabric about a longitudinal fold line into the first and second plies and the free edges are opposite from the longitudinal fold line.

17. The method of claim 1 further comprising:

rotating at least one transport member to thereby advance the fabric with the at least one rotating transport member located downstream from a position at which the longitudinal seam is formed, wherein the rotating transport member has a fixed axis of rotation and rotates through an arc of 360° .

18. A method of forming a string of pocketed coil springs comprising the steps of:

feeding a supply of fabric having first and second generally parallel plies;

inserting a series of compressed springs between the first and second plies;

joining the first and second plies together to form a longitudinal seam proximate free edges of the first and second plies;

allowing the springs to at least partially expand within the fabric so that a longitudinal axis of each of the springs is generally perpendicular to the longitudinal seam of the fabric; and forming a transverse seam in the fabric generally parallel to the longitudinal axis of the springs and between adjacent springs to thereby enclose each of the springs within a fabric pocket;

wherein the expansion of the springs is controlled by a pair of spaced rotating members with the springs therebetween.

19. The method of claim 18 wherein the axes of rotation of the rotating members are generally parallel to the longitudinal axes of the springs and each rotating member comprises a plurality of arcuate shaped recesses which combine to at least partially surround each spring.

20. The method of claim 18 wherein the axes of rotation of the rotating members are generally perpendicular to the longitudinal axes of the springs and each rotating member comprises a band passing over spaced rollers, wherein a separation distance between the bands increases in a downstream direction to thereby control the expansion of the springs between the bands.

21. The method of claim 18 wherein the joining of the first and second plies to form a longitudinal seam and the forming of the transverse seam are each accomplished by welding the first and second plies together at the respective locations.

22. A method of forming a string of pocketed coil springs comprising the steps of:

feeding a supply of fabric having first and second generally parallel plies;

inserting a series of compressed springs between the first and second plies;

joining the first and second plies together to form a longitudinal seam proximate free edges of the first and second plies;

allowing the springs to at least partially expand within the fabric so that a longitudinal axis of each of the springs is generally perpendicular to the longitudinal seam of the fabric; and forming a transverse seam in the fabric generally parallel to the longitudinal axis of the springs and between adjacent springs to thereby enclose each of the springs within a fabric pocket;

rotating at least one transport member about a fixed axis to thereby advance the fabric with the at least one rotating transport member located downstream from a position at which the longitudinal seam is formed, the rotating transport member comprises a plurality of arcuate shaped recesses which at least partially surround each spring.

23. The method of claim 22 wherein the rotating transport member rotates through an arc of 360°.

24. A method of forming a string of pocketed coil springs comprising the steps of:

feeding a supply of fabric;

folding the fabric about a longitudinal fold line into first and second generally parallel plies of the fabric;

inserting a series of compressed springs between the first and second plies;

joining the first and second plies together to form a longitudinal seam proximate free edges of the first and second plies opposite from the longitudinal fold line;

allowing the springs to at least partially expand to an extent permitted by the fabric so that a longitudinal axis of each of the springs is generally perpendicular to the longitudinal seam of the fabric; and forming a transverse seam in the fabric generally parallel to the longitudinal axis of the springs and between adjacent springs to thereby enclose each of the springs within a fabric pocket, wherein the forming of the transverse seam includes a first and a second transverse seam forming member which are located on opposite sides of the fabric and cooperate to form the transverse seam, the forming further comprising rotating the first transverse seam forming member;

wherein the transverse seam is formed after the springs are allowed to at least partially expand.

25. The method of claim 24 further comprising:

reciprocating the second transverse seam forming member toward and away from the first transverse seam forming member; and synchronizing the rotating and reciprocating of the first and second transverse seam forming members, respectively, for forming the transverse seam.

26. The method of claim 24 further comprising:

at least partially surrounding each spring with one of a plurality of recesses on the first transverse seam forming member.

27. The method of claim 24 wherein the springs are allowed to expand to the fullest extent permitted by the fabric prior to forming the transverse seam.

* * * * *